US006572323B2

(12) United States Patent
Schupback

(10) Patent No.: US 6,572,323 B2
(45) Date of Patent: Jun. 3, 2003

(54) LIFT ARM STRUCTURE FOR A WORK VEHICLE

(75) Inventor: Jesse Larry Schupback, Burlington, IA (US)

(73) Assignee: Case Corporation, Racine, WI (US)

( * ) Notice: Subject to any disclaimer, the term of this patent is extended or adjusted under 35 U.S.C. 154(b) by 0 days.

(21) Appl. No.: 09/848,946

(22) Filed: May 4, 2001

(65) Prior Publication Data

US 2002/0085905 A1 Jul. 4, 2002

Related U.S. Application Data

(60) Provisional application No. 60/259,044, filed on Dec. 29, 2000.

(51) Int. Cl.[7] ..... E02F 3/36

(52) U.S. Cl. ..... 414/722; 414/686; 29/891; 52/111

(58) Field of Search ..... 414/722, 686; 29/891, 897.2, 897.31; 52/111, 116

(56) References Cited

U.S. PATENT DOCUMENTS

| | | | | |
|---|---|---|---|---|
| 2,610,754 A | | 9/1952 | Inskeep | |
| 2,910,190 A | | 10/1959 | Baas | |
| 4,155,470 A | | 5/1979 | Moore et al. | 414/727 |
| 4,193,734 A | | 3/1980 | Williams | 414/694 |
| 4,297,815 A | | 11/1981 | Moro et al. | 414/727 |
| 4,439,089 A | | 3/1984 | Anderson et al. | 414/722 |
| 4,904,151 A | | 2/1990 | Biemans et al. | 414/727 |
| 4,973,214 A | | 11/1990 | Schupback et al. | 414/727 |
| 5,611,657 A | * | 3/1997 | Peterson | 414/722 |

* cited by examiner

*Primary Examiner*—Donald W. Underwood
(74) *Attorney, Agent, or Firm*—A. N. Trausch

(57) ABSTRACT

A lift structure for a work vehicle including a pair of lift arms arranged on opposite sides of the work vehicle, each lift arm having a first end pivotally coupled to the work vehicle and a second end for coupling to a tool. Each lift arm includes a first side plate member, a second side plate member, an elongated top tubular member and a bottom member. Each side plate member has a plurality of pivot orifices including at least one pivot orifice near each end of the side plate members and at least one intermediate pivot orifice located between each end of the side plate members. The elongated top tubular member is attached between each of the parallel side plate members at the top edge so as to connect to each side plate member. A bottom member is positioned in a spaced relationship from the top member between each side member and is connected to each side member. The top tubular member provides additional strength to the side plate members to resist bending and torque loads. A traverse torque member is mounted between each lift arm and is connected to each side member of each lift arm. A material handling tool, such as a loader bucket, can be coupled to the second end of each lift arm.

18 Claims, 4 Drawing Sheets

LIFT ARM STRUCTURE FOR A WORK VEHICLE

This application claims benefit of Provisional Application No. 60/259,044 filed Dec. 29, 2000.

FIELD OF THE INVENTION

The present invention relates generally to material handling work vehicles and, more particularly, to a lift arm structure for a work vehicle such as a front loader.

BACKGROUND OF THE INVENTION

Work vehicles having a front material-handling tool are commonly used in agriculture or in the earth-moving construction industry. Typically the work vehicle includes a hydraulically operated lift arm structure having a pair of lift arms. A material-handling implement or tool is coupled to the front end of the lift arm structure to move materials around a farm or construction site. Such tools may include tilting buckets, fork lift arms, balers, claws, etc. The tools typically are raised or lowered by a single or a pair of hydraulic actuators such as hydraulic cylinders, which move the tool from one vertical position to another position.

The lift arm structure is thus used to engage, lift and carry loads. Typically for a front loader, a pair of load lifting arms are each pivotally connected at their rear or proximal ends to the work vehicle. Typically, each lift arm is provided with its own hydraulic actuator for cooperatively raising and lowering the lift arms. For some front loaders, another pair of hydraulic cylinders, or alternatively a single cylinder, mounted on the lift arm structure provides further functions for the tool, such as tilting or dumping.

Many lift arm structures include a vertical bend or knee having an obtuse angle at an intermediate position along the longitudinal extent of the lift arm. The knee in the lift arm allows clearance for the front tires to turn in or out and to move vertically due to the vehicle suspension without hitting the lift arm when the arm is in a vertically lower position.

A tool, such as a tilting bucket, is connected between the forward or distal ends of each pair of lift arms. Often these tools may be wider than the vehicle width, such as for example, wide loader buckets. These wider tools may require the lift arms to converge to the vehicle width at their proximal ends. Convergent arms also allow the operator to better see the back edge or corner of the tool relative to the ground, for example. However lift arms that fully converge directly in a straight line from the tool to the vehicle require a more complex connection to the tool, especially if the work vehicle uses an additional pair of hydraulic cylinders to function the tool. It would be desirable to construct a semi-convergent lift arm that has a parallel portion at the distal end of the arm for mounting the pair of tool functioning cylinders. However, such an arm may need both a vertical knee and a semi-convergent horizontal bend along the longitudinal extent of the arm.

During material handling operations, relatively high bending and torque stresses are repeatedly imparted to the lift arm structure. These stresses include bending stresses when a heavy load is picked up or a twisting torque stress when one side of a load is unbalanced and weighs more than the other side of the load. These stresses are a result of different load forces acting on the lift arm structure during the operation of the work vehicle.

The lift arm structure must be strong to withstand these stresses. Since the weight of the materials used to make the lift arm structure can reduce the lifting and load capacity of the tool, lift arms are often fabricated as hollow, multiple-walled structures. One known multiple-walled lift arm is a hollow arm fabricated from a single piece of metal that is formed into a three-sided, open bottom, U-shaped arm structure. Another known arm is formed by a closed four-walled arm structure. Another known arm is formed from two C-shaped channel pieces that are joined together to form a hollow, four-walled structure.

However, in order to provide a lift arm with the vertical knee configuration, the above known hollow arms must be fabricated as two separate longitudinal sections. The separate sections are then longitudinal butted together and joined. Often a metal plate is positioned over the joint and welded to each sidewall section to reinforce the joint. Fabricating, positioning and attaching these sections increases manufacturing costs.

It is common to provide reinforcing plates that are welded to the sidewalls at selected locations along the lift arm structure where pivot pins and actuators are attached. It is also known to provide a shaped debris deflecting member on the top of each lift arm to protect the lift arm from collecting falling debris While the above known arm configurations add strength to the lift arm structure, they also increase the cost to manufacture the lift arm structure. Moreover, these structural features may not be readily adaptable to the semi-converging lift arm configurations increasingly needed for wider tools.

Thus, there is a need for a lift arm structure that is lightweight and yet resistant to bending and torque stress. Preferably two sidewall members can be fabricated from flat plate material that needs only minimal forming. Preferably a simple structural member can be easily and economically attached between the two side plate members to position and reinforce the two flat sidewalls. Preferably a top member can deflect debris.

There is also a need for a strong, lightweight arm cross-section that can be readily fabricated with both a vertical knee and a horizontal bend for a semi-convergent configuration. The hollow lift arm structure must readily allow for at least one and preferably two angular transitions. For example, the hollow arm structure must transition at the vertical knee as well as allowing horizontal angle transition along the longitudinal extent for semi-converging arms.

Thus, there is a need for a lift arm structure that is strong, lightweight, reinforced against bending and torsion stress, requires minimal fabrication and is readily assembled.

SUMMARY OF THE INVENTION

A lift arm structure is provided for a work vehicle including a pair of lift arms arranged on opposite sides of the work vehicle. Each lift arm has a first end pivotally coupled to the work vehicle and a second end for coupling to a tool. Each lift arm includes an inner side plate member, an outer side plate member, an elongated top tubular member and a bottom member. Each side plate member has a plurality of pivot orifices including at least one pivot orifice near each end of the side plate member and at least one intermediate pivot orifice located between each end of the side plate member. The elongated top member is attached between each of the parallel side members at the top edge of the side plate member so as to connect substantially along the entire length of each side plate member. A bottom member is positioned in a spaced relationship from the top member between each side member and is connected to each side plate member. The elongated top tubular member provides additional strength to the plate members to resist bending and torque loads. A traverse member is mounted between each lift arm and connected to at least one of the pairs of inner sidewall plate members and outer sidewall plate members of each lift arm. Each side plate member can be fabricated with an integral lift attachment portion to increase fatigue strength.

The preferred tubular configuration for the top tubular member is rounded, with a circular tube being the most preferred. The tubular member is preferably joined to the side plate members at the top edge of the plate members. The tubular member can be bent vertically to accommodate a vertical knee configuration and can be bent horizontally to accommodate a semi-convergent configuration. A tubular bottom member can also be provided to further increase the strength of the lift arm for bending and torque loads.

A method for manufacturing a lift arm structure for a work vehicle includes the following steps. A pair of lift arms is formed preferably by cutting a first side member and a second side member from a flat plate of material such as a metal plate. The members may be cut to have a vertical knee. The cut arms may then be bent horizontally to have a horizontal semi-convergent configuration.

A plurality of pivot orifices are fabricated near each end of each side plate member and at least one intermediate pivot orifice is provided between each end of each side plate member. A pivot boss is attached at each pivot orifice.

An elongated top tubular member is bent appropriately and attached between the first inner sidewall plate member and the parallel second outer sidewall plate member along substantially the entire length of the top tubular member at the top edge of the plate members. Also a bottom member is attached between the first side plate member and the second side plate member in a spaced relationship from the top tubular member. The bottom member is attached to each side plate member along the length of the bottom member. A traverse member is attached to at least one of the pair of sidewall plate members between a pair of lift arm members. The lift arm structure can then be mounted for pivotal rotational on the work vehicle.

DETAILED DESCRIPTION OF THE PREFERRED EMBODIMENTS

Figure 1:
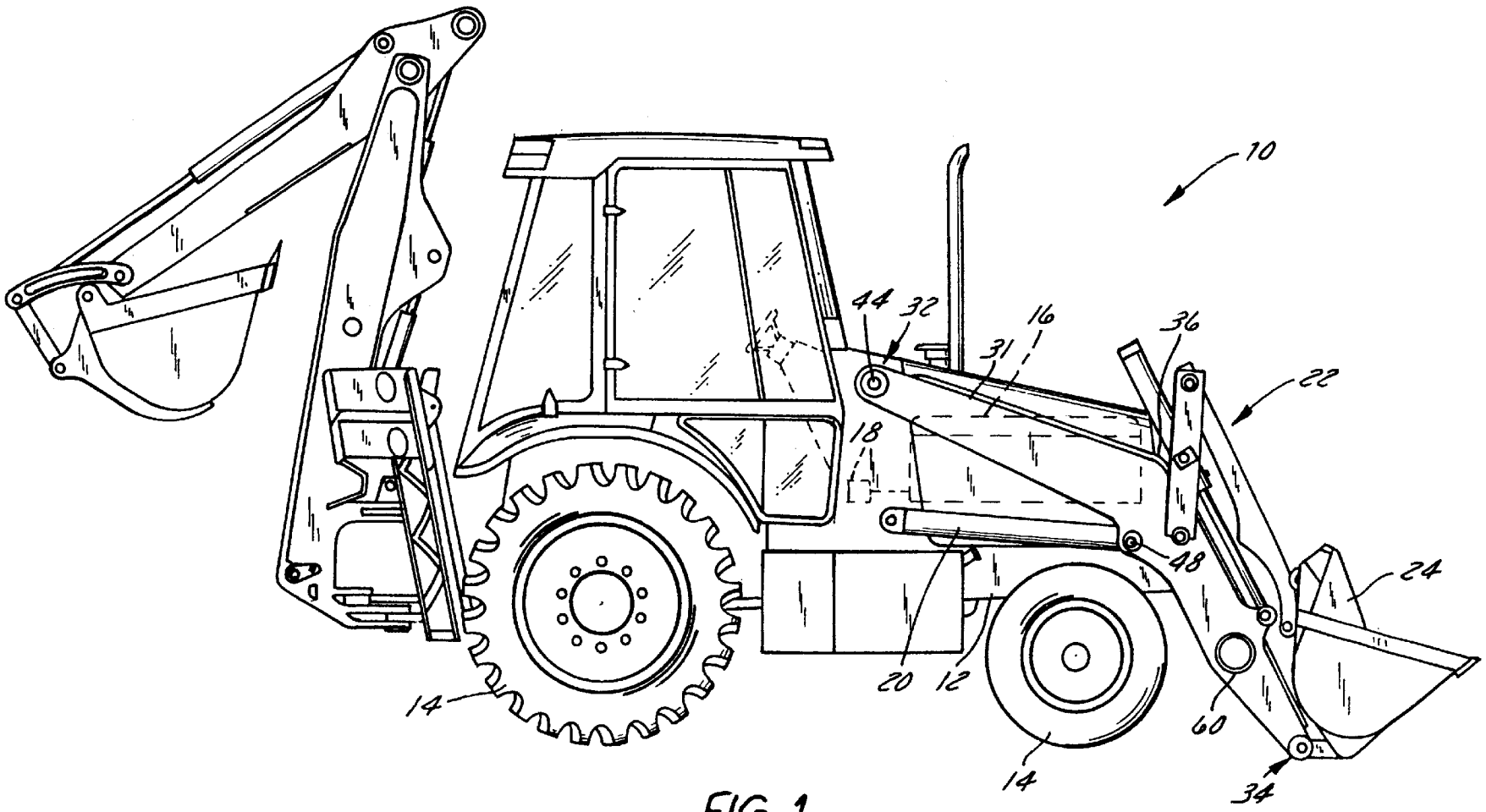
FIG. 1 is a side plan view of a work vehicle with one embodiment of a lift arm structure mounted on the front of the vehicle.

Turning now to the drawings, FIG. 1 illustrates a work vehicle 10, such as a tractor, with a front loader attachment. The tractor is also shown with a backhoe attachment. The work vehicle 10 has a rigid vehicle structure or chassis 12. Wheels 14 are rotatably mounted on the vehicle structure. The work vehicle 10 can also be an articulated vehicle or a tracked vehicle wherein the wheels support tracks.

An engine 16 is mounted on the vehicle structure 12 and is coupled to a transmission. The engine can be an internal combustion engine, such as a gasoline or diesel engine, or other suitable power source. The engine 16 and transmission can be configured to provide two or four-wheel drive to the vehicle 10. A fluid pump 18 can be coupled to the engine 16 to provide pressurized fluid to hydraulic actuators such as hydraulic cylinders 20. The hydraulic cylinders 20 can impart vertical motion to a pivotally mounted lift arm structure 22.

Coupled to the lift arm structure 22 is a material-handling implement or tool 24. For example, the tool 24 could be a tilting loader bucket, as shown, or a forklift arm, a claw mechanism, a planter attachment or a baler attachment. The work vehicle 10 and tool 24 can be used in the agricultural, industrial and construction industries. FIG. 1 illustrates a work vehicle 10 having a backhoe attachment mounted on the rear end of the work vehicle and one embodiment of the lift arm structure 22 of the present invention supporting a front loading, tilting bucket type tool at the front end of the work vehicle.

Figure 2:
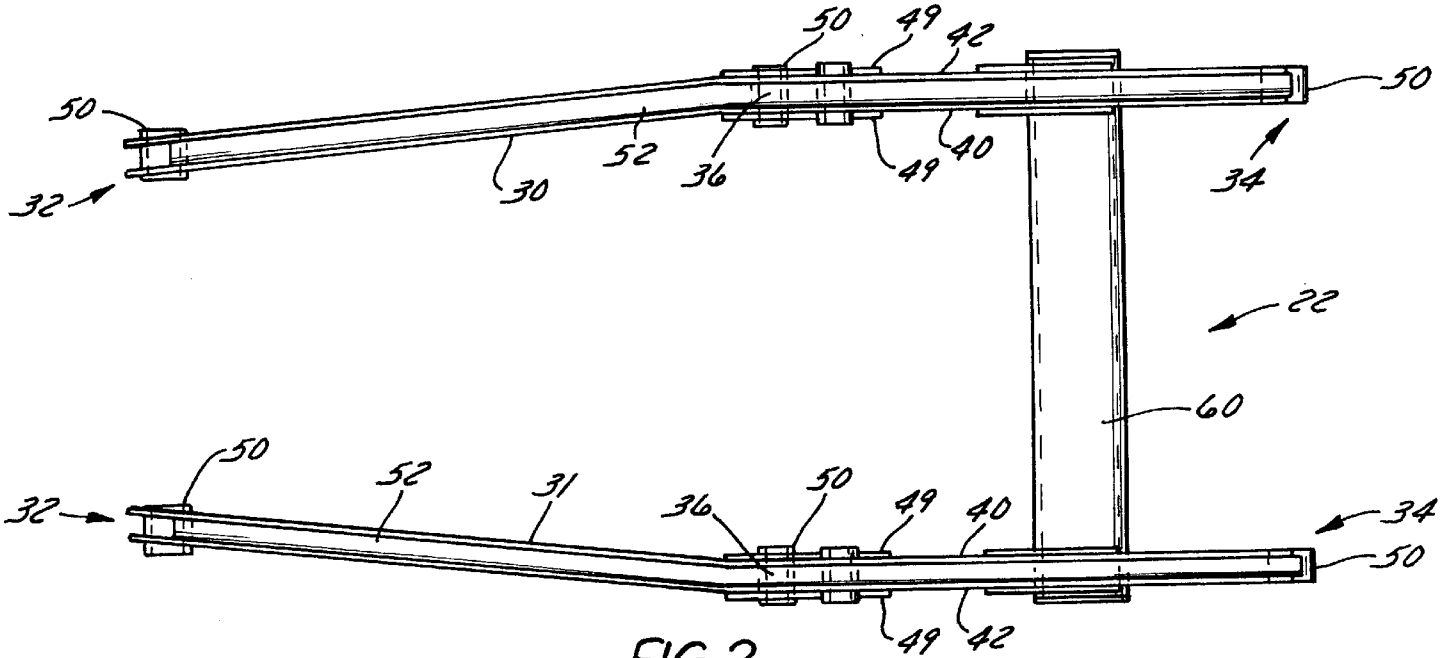
FIG. 2 is a top plan view of a preferred embodiment of a lift arm structure, and also shows a semi-converging lift arm structure.
Figure 3:
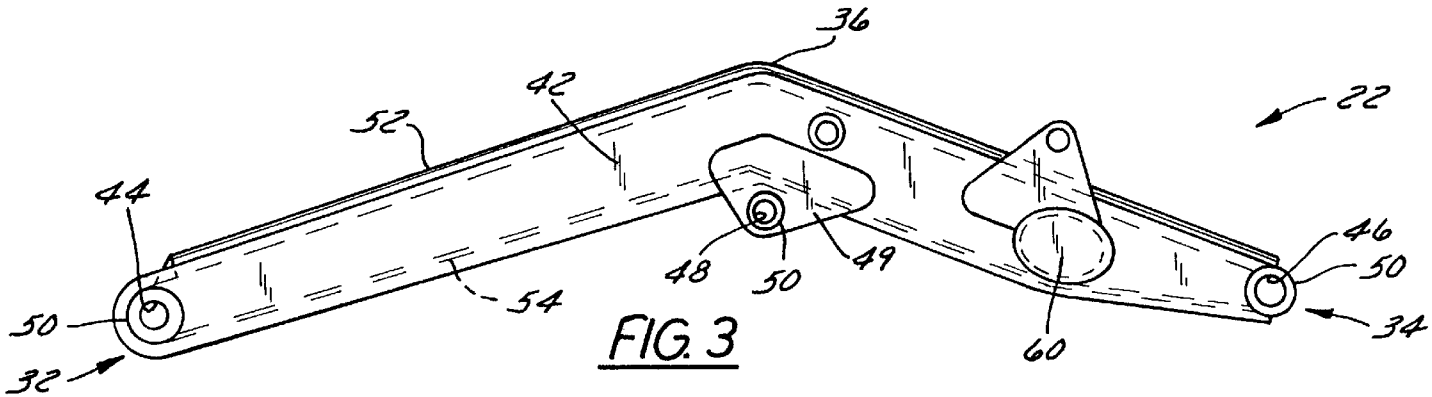
FIG. 3 is a side plan view of the lift arm structure illustrated in FIG. 2.

The lift arm structure 22 of the present invention, as seen in FIGS. 2 and 3, includes a pair of lift arms 30 and 31 arranged transversely on opposite sides of the work vehicle 10. Each lift arm 30 and 31 has a first proximal or rear end 32 pivotally coupled to the work vehicle 10 and a second distal or front end 34 configured to couple to the material-handling tool 24. The lift arm structure 22 is coupled to the work vehicle 10 with one arm 30 and 31 mounted on each side of the work vehicle 10.

Each lift arm 30 and 31 of the lift arm structure preferably has a small knee 36 or vertical bend between the proximal and distal ends of the lift arms. A small obtuse angle along the longitudinal extent of the lift arm defines the knee 36. The knee 36 permits the front wheels of the vehicle to fully turn in and out and to move up and down by the vehicle suspension without interfering with the lift arm when the arm is in a lower position.

Figure 4:
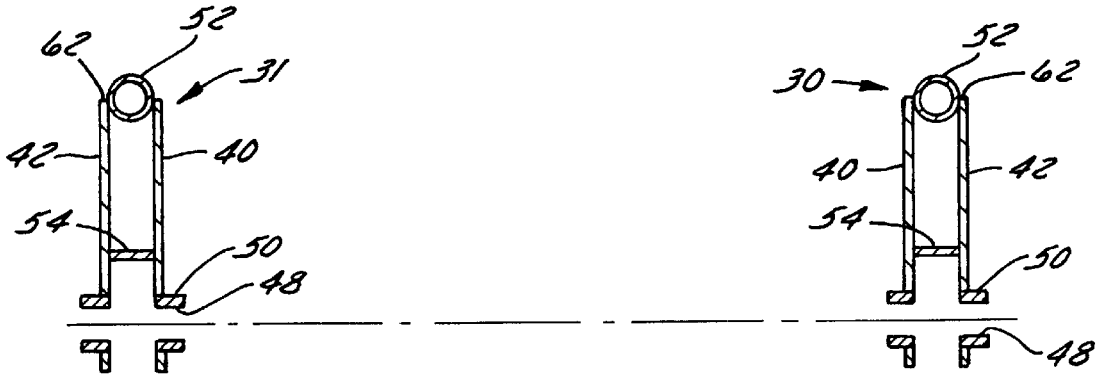
FIG. 4 is a cross-sectional view of the lift arm structure illustrated in FIG. 3 or 3A along the line 4—4 in FIG. 3A.

As best seen in FIG. 4, each lift arm 30 and 31 of the present invention has a hollow box-like cross-section having a first inner side wall or plate member 40 and a second outer side wall or plate member 42. Each side wall or plate member 40 and 42 can be cut or formed from appropriate flat plate material such as steel plate having suitable thickness and strength for the bending and torsion forces to be imparted to lift arm structure. Alternatively, the side wall or plate members can be formed from appropriate flat or sheet material such as a composite material having suitable thickness and strength for the applied bending and torsion forces.

As seen in FIG. 3, each lift arm and thus each side wall or plate member 40 and 42 has a plurality pivot orifices for pivotal attachment to the vehicle and for pivotal attachment of actuators and tools. The pivot orifices are aligned through each sidewall member and through each lift arm 30 and 31. A proximal vehicle attachment pivot orifice 44 is located near the proximal end 32 of the side plate members 40 and 42. A distal tool attachment pivot orifice 46 is located near the distal end 34 of the side plate members 40 and 42.

Figure 3A:
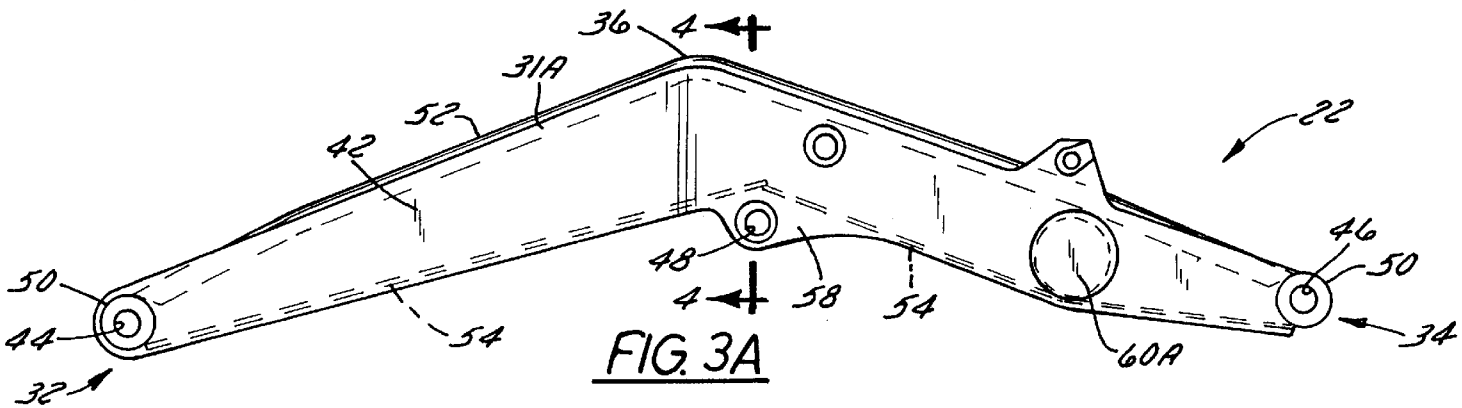
FIG. 3A is a side plan view of the lift arm structure illustrated in FIG. 2A.

At least one intermediate lift cylinder pivot orifice 48 is located between the proximal and distal pivot orifices. A separate flat plate 49 can be attached near the knee 36 as shown in FIG. 3 or an integral portion 58 is provided when the side walls are cut as shown in FIG. 3A. Pivot bosses 50, as shown in FIG. 4, are attached to each side wall or plate member 40 and 42 (or to the attached plate 49 for example) at each pivot orifice 44, 46 and 48. Preferably the bosses 50 are hardened sleeves or rings of appropriate material that are attached in or around the pivot orifice holes in each of the side plate members.

Figure 5:
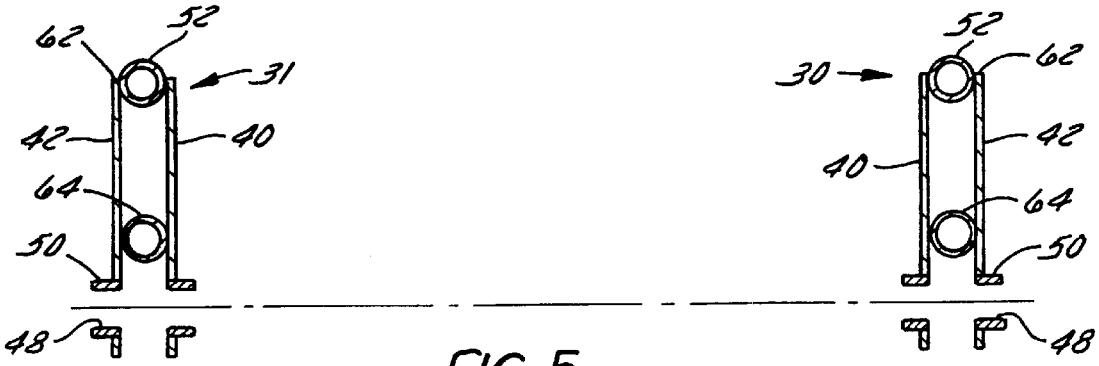
FIG. 5 is a cross-sectional view of an alternate embodiment of a lift arm structure shown in FIG. 4.

As best seen in FIGS. 4 and 5, an elongated top member 52 is positioned between each of the parallel side wall or plate member 40 and 42 and connected to each side plate member along the length of the top member. The top member 52 provides the primary spacing or positioning between the parallel side wall or plate members 40 and 42 as well as providing some additional resistance to bending stress and torsion stress that is applied to the lift arm structure 22 during use. The top member 52 is preferably a single elongated tubular member so as to reduce manufacturing and assembly costs. The tubular member 52 can be readily bent to conform to the top edge profile of the side wall members 40 and 42.

At least one bottom member 54 is positioned in a vertically spaced relationship from the top member 52 between each side wall or plate member 40 and 42 and connected to each side member. It should be noted that the bottom member 54 may be constructed of a flat stock and may be more than one piece because of the several bends in the preferred configuration of the bottom edge of the lift arm structure 22.

The top member 52 and bottom member 54 are typically attached to each side plate member 40 and 42 by an appropriate joining process, preferably such as by welding, thereby forming the hollow box-like cross-section as best seen in FIG. 4. If a composite material is used, other appropriate material bonding processes can be used to attach the top and bottom members to the side plate members.

Figure 2A:
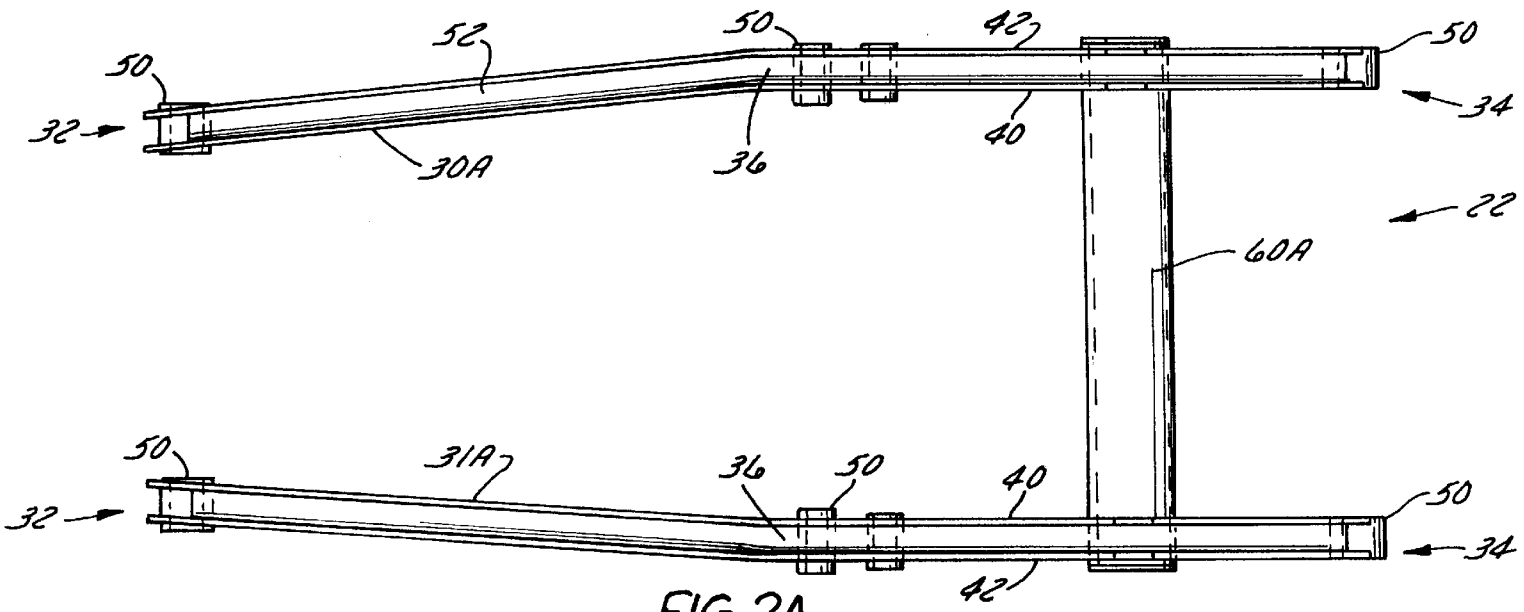
FIG. 2A is a top plan view of another embodiment of a lift arm structure, and also shows a semi-converging lift arm structure.

The two lift arms 30 and 31 of the lift arm structure 22 are maintained in a spaced apart relationship by a traverse torsion member 60 (or 60A) mounted between each lift arm 30 and 31 (or lift arms 30A and 31A). The torsion member 60 is connected to at least one of the inner sidewall or plate member 40 and/or the outer sidewall or plate member 42 of each lift arm. The traverse member 60 can be of any suitable cross-section, with the preferred cross-sections being oval 60 or round 60A. The traverse member 60 is preferably made from the same material as the lift arm 30 and 31. The traverse member 60 is attached to each side wall member 40 and 42 of each lift arms 30 and 31 by an appropriate joining process, preferably such as by welding, thereby forming the lift arm structure 22 as best seen in FIGS. 2 and 2A. If a composite material is used, other appropriate material bonding processes are used to attach the transverse torsion member 60 to the side wall or plate members.

In a first embodiment of the lift arm structure 22, shown in FIG. 4, the elongated top tubular member 52 of each lift arm 30 and 31 is a single elongated tubular member having a rounded, and preferably circular, cross-section. The top tubular member 52 is formed and mounted between the parallel side wall or plate members 40 and 42 along the top edge 62 of the side wall or plate members. Approximately the top half portion of the tubular member 52 extends beyond, that is above, the top edge 62 of the side plate members 40 and 42. The tubular top member 52 extends substantially the full length of the side wall members 40 and 42 of each lift arm 30 and may be joined to the pivot bosses 50 at the proximal pivot orifice 44 and distal pivot orifice 46 of each lift arm. The longitudinally extending tubular member 52 provides additional resistance to bending and torque loads that are applied to the lift arm structure 22.

The rounded cross-section of the top tubular member 52 extends above the top edge 62 of the sidewalls and repels debris falling onto the lift arm structure 22. Falling debris could be carried on the lift arms and later fall back on the operator when the lift arms are raised. In the first embodiment of FIG. 4, the bottom member 54 is made from flat stock and is attached between the side wall or plate members.

In another embodiment of the lift arm structure 22, shown in FIG. 5, the bottom member 64 is also a tubular member having a rounded cross-section. The bottom tubular member 64 is joined to each side plate member 40 and 42 along the length of the lift arms 30 and 31 and provides further resistance to bending and torque loads. It should be noted that the tubular bottom member 64 may also be constructed of more than one piece because of the several bends in the preferred configuration of the bottom edge of the lift arm structure 22. Thus a strong and light weight lift arm structure as shown in either FIG. 4 or FIG. 5 can be readily fabricated and easily assembled with a cross-section which provides additional strength to resist bending and torsion loads and to deflect falling debris.

The side wall or plate members 40 and 42 of each lift arm 30 of the lift arm structure 22 may include a separately attached lift attachment plate 49 shown in FIG. 3 or an integral lift attachment portion 58 shown in FIG. 3A. The vertical protruding lift attachment portion 39 or 58 provides an offset location for the lift cylinder pivot orifice 48 and a respective pivot boss 50. The integral lift attachment portion 58 of the side wall or plate members 40 and 42 can be readily incorporated into the profile of the side plate members 40 and 42 during fabrication. The integral lift attachment portion 58 resists fatigue stress. Separate plates 49 that are welded-on are also used for attaching the lift cylinders 20.

As shown in FIG. 1, the lift arm structure 22 is pivotally coupled to the work vehicle 10 at the vehicle attachment pivot orifices 44 for each lift arm 30 and 31. A pair of lift cylinders 20 are coupled to the work vehicle 10 and to the respective lift arms 30 and 31 at the lift cylinder pivot orifices 48 at the lift attachment portion 39 or 58. Each lift cylinder 20 is preferably a hydraulic fluid cylinder that is operatively in communication with the fluid pump 18 mounted on the work vehicle 10. The lift cylinders 20 are usually double acting hydraulic cylinders with appropriate controls mounted in the cab portion of the work vehicle 10.

A method for manufacturing the lift arm structure 22 for a work vehicle includes the following steps. The first of a pair of lift arms 30 and 31 are fabricated, each arm including a first side wall or plate member 40 and a second side wall or plate member 42, each preferably cut from a flat plate of material. Each side wall or plate member can include a vertical knee profile 36. The side wall members 40 and 41 can then be bent horizontally or formed to provide the proper semi-convergent profile, if desired.

Pivot orifices 44 and 46 are provided at the proximal and distal ends 32 and 34 of each side wall members 40 and 42. A lift attachment plate 39 can be added to the side walls if an integral portion 58 is not cut into the original side wall profile. A pivot orifice 48 is provided on the lift attachment plate 39 or integral portion 58 between the two end pivot orifices. Additional pivot orifices 50 may be provided for coupling actuators to manipulate the various types of material handling tools 24. A pivot boss 50 is provided for each pivot orifice. The pivot bosses 50 allow for coupling various pins, actuators or the like in the assembly of the lift arm structure.

An elongated tubular top member 52 is formed and bent as required and positioned between the first side wall or plate member 40 and the parallel second side wall or plate member 42. The top tubular member 52 is easily attached, such as by welding, along the edge of each side wall or plate members 40 and 42 along the length of the top tubular member 52. A bottom member 54 or 64 is positioned between the first side wall or plate member 40 and the second side wall or plate member 42 in a vertically spaced relationship from the top tubular member 52 and is attached to each side member 40 and 42 along the length of the bottom member.

A second lift member is fabricated according to the above steps. The traverse torsion member 60 is mounted between the pair of lift arms 30 and 31 and attached to at least one pair of the inner side plate members 40 and/or the outer side plate members 42. The lift arm structure 22 is then mounted to each side of the work vehicle 10 for pivotal rotation on the work vehicle 10.

FIGS. 2 and 2A show the configuration of the two lift arms 30 and 31 spaced apart by the traverse members 60 and 60A. FIG. 1 illustrates the lift arm structure 22 mounted on a work vehicle 10 and supporting a bucket type tool 24 at the distal end of the lift structure.

Thus, a lift arm structure for a work vehicle is provided with each lift arm of the lift arm structure having a strong yet simple hollow cross-section. The hollow cross section is fabricated primarily from two substantially flat side wall members cut from a flat plate. An elongated tubular member is provided between the two sidewall or plate members to provide spacing, to increase bending and torque strength and to provide debris deflection. While several embodiments of the present invention have been disclosed and described in detail herein, various modifications may be made. For example, the preferred embodiment of a work vehicle describes a vehicle having a frame that supports an engine, transmission and wheels. Some vehicle structures, such as agricultural tractors don't have a frame as a support structure but use the engine block and transmission housing as part of the support structure for the wheels and axles. Such modifications and variations in use are intended to fall within the scope of the appended claims.

What is claimed is:

1. A lift arm structure for a work vehicle having a pair of transversely spaced lift arms arranged on opposite sides of the work vehicle, each lift arm extending longitudinally with a proximal end and a distal end, the proximal end pivotally coupled to the work vehicle to allow vertical movement of the distal end of the lift arm, each of the pair of lift arms comprising:

a first inner side wall member and a second parallel outer side wall member;

a tubular top member positioned between the inner side wall member and outer side wall member and connected to both the inner aide wall member and the outer side wall member; and at least one bottom member positioned in a vertically spaced relationship from the top member between the inner side wall member and the outer side wall member and connected to both the inner side wall member and the outer side wall member, wherein the inner and outer side wall members are substantially flat and each side wall member has a top edge along the longitudinal extent of the member and wherein the top tubular member of each lift arm is a single elongated tubular member that has a longitudinal length and a rounded cross-section and is attached between the inner side wall member and the outer side wall member along the respective top edge substantially along the entire longitudinal length of the side wall members with a portion of the top tubular member extending vertically beyond the top edge of the inner side wall member and the outer side wall member.

2. The lift structure of claim 1, wherein the top tubular member of each lift arm is a tube having a circular cross-section.

3. The lift structure of claim 1, wherein the bottom member of each lift arm is a tube having a round cross-section.

4. The lift arm structure of claim 1, wherein each lift arm has a knee defined by an obtuse angle between the proximal and distal ends.

5. The lift structure of claim 4, wherein the pair of transverse lift arms converge toward each other along a portion of the longitudinal extent near the proximal end of each lift arm.

6. The lift structure of claim 1, wherein the pair of transverse lift arms converge toward each other along a portion of the longitudinal extent near the proximal end of each lift arm.

7. The lift structure of claim 1, wherein each side plate member includes an integral lift attachment portion for an intermediate pivot orifice.

8. The lift structure of claim 7, including a pair of lift cylinders for coupling to the work vehicle and to a respective lift arm at the intermediate pivot orifice for each lift arm.

9. A work vehicle, comprising:

a vehicle structure;

an engine mounted on the vehicle structure;

a plurality of wheels rotatably mounted on the vehicle structure and coupled to the engine;

a fluid pump mounted on the vehicle structure and coupled to the engine;

a lift arm structure including a pair of transverse lift arms arranged on opposite sides of the work vehicle, each lift arm extending longitudinally and having a first proximal end pivotally coupled to the work vehicle and a second distal end, each lift arm comprising:

a first inner side plate member and a second parallel outer side plate member;

a tubular top member positioned between the inner side plate member and outer side plate member and connected along both the inner side plate member and the outer side plate member; and at least one bottom member positioned in a vertically spaced relationship from the top member between the inner side plate member and the outer side plate member and connected to both the inner side plate member and the outer side plate member, wherein the inner and outer side plate members are substantially flat and have a top edge along the longitudinal extent of the plate members and wherein the top tubular member of each lift arm is a single elongated member that has a longitudinal length and a rounded cross-section and is attached between the inner side plate member and the outer side plate member along substantially the entire longitudinal length of the inner and outer side plate with a portion of the tubular member extending vertically beyond the top edge of the inner and outer side plate members.

10. The work vehicle of claim 9 wherein the top tubular member of each lift arm is a tube having a circular cross-section.

11. The work vehicle of claim 9, wherein the bottom member of each lift arm is a tube having a round cross-section.

12. The work vehicle of claim 9 wherein the pair of transverse lift arms converge toward each other along a portion of the longitudinal extent near the proximal end of each lift arm.

13. The lift arm structure of claim 12, wherein the lift arms have a knee defined by an obtuse angle between the proximal and distal ends.

14. The work vehicle of claim 9 wherein the pair of transverse lift arms converge toward each other along a portion of the longitudinal extent near the proximal end of each lift arm.

15. The work vehicle of claim 14, wherein each side plate member includes an lift attachment portion for an intermediate pivot orifice and a pair of lift cylinders is coupled to the work vehicle and to a respective lift arm at the intermediate pivot orifice for each lift arm.

16. A method for manufacturing a lift arm structure for a work vehicle, the method comprising the steps of:

a. making a pair of longitudinally extending lift arms, including:
   1. forming an inner side plate member and an outer side plate member;
   2. fabricating a pivot orifice near each end of each side plate member and at least one intermediate pivot orifice between each end of each side plate member;
   3. attaching a pivot boss at each pivot orifice;
   4. positioning an elongated top tubular member between the first side plate member and the second side plate member at a top edge of the parallel side plate members;
   5. attaching each side plate member substantially along the entire length of the top tubular member;
   6. positioning at least one bottom member between the first side member and the second side member in a spaced relationship from the top tubular member; and,
   7. attaching each side plate member substantially along the entire length of the bottom member;

b. mounting a traverse member between the pair of lift arms; and c. attaching the traverse member to at least one pair of the inner side plate members and the outer side plate members of the lift arms.

17. The method of claim 16, wherein the step of forming an inner and an outer side plate member comprises cutting the side plate members from a substantially flat sheet of material.

18. The method of claim 17 further comprising the step of bending the side plate members between the distal and the proximal ends to provide a semi-convergent configuration along a portion of the longitudinal extent near the proximal end.

* * * * *